US011409246B2

(12) United States Patent
Mokuya

(10) Patent No.: US 11,409,246 B2
(45) Date of Patent: Aug. 9, 2022

(54) TIME DISPLAY APPARATUS AND TIME CORRECTION METHOD

(71) Applicant: SEIKO EPSON CORPORATION, Tokyo (JP)

(72) Inventor: Senichi Mokuya, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 637 days.

(21) Appl. No.: 16/416,350

(22) Filed: May 20, 2019

(65) Prior Publication Data

US 2019/0354070 A1 Nov. 21, 2019

(30) Foreign Application Priority Data

May 21, 2018 (JP) ..... JP2018-096855

(51) Int. Cl.
*G04G 9/00* (2006.01)
*G04G 21/02* (2010.01)
*G04G 21/04* (2013.01)

(52) U.S. Cl.
CPC ..... *G04G 9/0076* (2013.01); *G04G 21/02* (2013.01); *G04G 21/04* (2013.01)

(58) Field of Classification Search
CPC ..... G04G 9/0076; G04G 21/02; G04G 21/04; G04G 21/00; G04G 5/00; G04C 3/146; G04C 9/08; G04R 20/26; G04R 20/02; G04B 47/066
USPC ..... 368/21
See application file for complete search history.

(56) References Cited

U.S. PATENT DOCUMENTS 8,264,914 B2 * 9/2012 Baba ..... G04R 20/06 368/47
9,571,959 B2 2/2017 Oizumi et al.
2015/0268638 A1 * 9/2015 Hasegawa ..... G04C 3/14 368/47
2017/0060098 A1 * 3/2017 Yonekura ..... G04G 9/0076
2017/0277141 A1 * 9/2017 Sekitsu ..... G04R 20/10
2018/0004169 A1 * 1/2018 Matsuzaki ..... G06F 1/1658
2018/0173168 A1 * 6/2018 Hasegawa ..... G04R 20/02

FOREIGN PATENT DOCUMENTS

JP 2014-211430 A 11/2014

* cited by examiner

*Primary Examiner* — Edwin A. Leon
(74) *Attorney, Agent, or Firm* — Oliff PLC

(57) ABSTRACT

A time display apparatus includes a display section that displays the time, a first receiver that receives a wireless signal containing information on the time zone corresponding to a destination from a transmitter provided in a moving object, a second receiver that receives a satellite signal from a positioning satellite to perform positioning and calculates position information, and a processor that is capable of selectively executing a first process of setting time to be displayed on the display section based on the time zone information and a second process of setting the time to be displayed on the display section based on the position information and does not execute the second process for the period until the processor determines that a predetermined condition is satisfied in a case where the first receiver has received the wireless signal.

11 Claims, 8 Drawing Sheets

TBL

| AIRPORT CODE | TIME ZONE (TIME DIFFERENCE) |
|---|---|
| NRT | UTC+8 |
| HND | UTC+8 |
| : | : |
| YYZ | UTC−9 |

TIME DISPLAY APPARATUS AND TIME CORRECTION METHOD

The present application is based on, and claims priority from Japanese Application Serial Number 2018-096855, filed May 21, 2018, the disclosure of which is hereby incorporated by reference herein in its entirety

BACKGROUND

1. Technical Field

The present disclosure relates to a time display apparatus and a time correction method.

2. Related Art

There is a known time display apparatus that externally acquires information on a time zone and displays the time in the time zone. For example, the in-plane system described in JP-A-2014-211430 includes a base station installed in the airplane, a terminal device wirelessly connectable to the base station, a server connected to the base station, for example, via a cable. The base station acquires information on the destination of the airplane from the server and determines a time zone corresponding to the destination. The base station then produces a time correction instruction based on the determined time zone corresponding to the destination and transmits the produced time correction instruction to the terminal device. The terminal device is, for example, a smartphone, a tablet terminal, or a notebook personal computer, receives the time correction instruction transmitted from the base station, decodes the information on the time zone acquired from the received time correction instruction, and changes the current time held by the terminal device itself to the time in the time zone corresponding to the destination.

JP-A-2014-211430 is an example of the related art.

The terminal device, such as a smartphone, a tablet terminal, and a notebook personal computer, has in some cases, for example, the function of identifying a time zone based on a positioning result using the GPS (global positioning system) and displaying the time in the time zone. The terminal device having this function, when used in an airplane, undesirably receives a GPS signal that enters the airplane and displays the time based on information on the time zone corresponding to the current location of the airplane. Therefore, simply using the terminal device having the function described above in the in-plane system described in JP-A-2014-211430 causes a problem of replacement of the time displayed on the terminal device with unintended time even after the time is changed based on the information on the time zone corresponding to the destination.

SUMMARY

A time display apparatus according to an aspect of the present disclosure includes a display section that displays time, a first receiver that receives a wireless signal containing information on a time zone corresponding to a destination from a transmitter provided in a moving object, a second receiver that receives a satellite signal from a positioning satellite to perform positioning and calculates position information, and a processor that is capable of selectively executing a first process of setting time to be displayed on the display section based on the time zone information and a second process of setting the time to be displayed on the display section based on the position information and does not execute the second process for a period until the processor determines that a predetermined condition is satisfied in a case where the first receiver has received the wireless signal.

DESCRIPTION OF EXEMPLARY EMBODIMENTS

Figure 1:
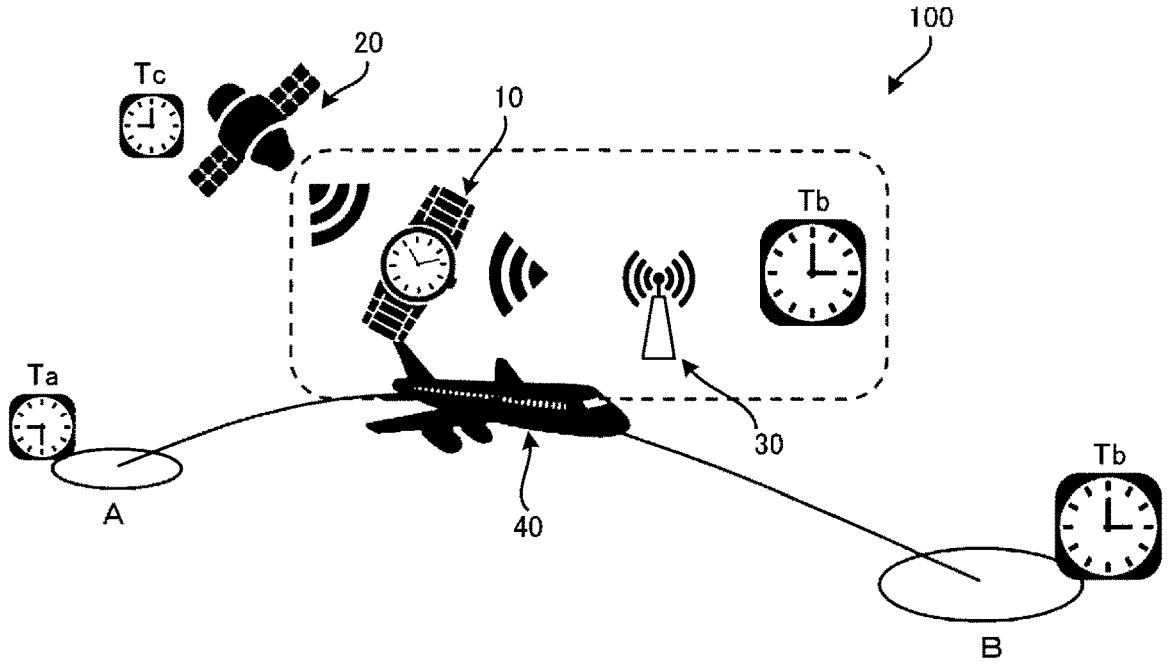
FIG. 1 shows an overview of the entirety of a system using a time display apparatus according to a first embodiment.

Preferable embodiments according to the present disclosure will be described below with reference to the accompanying drawings. In the drawings, the dimension and scale of each portion differs from actual values as appropriate, and some portions are diagrammatically shown for ease of understanding. The scope of the present disclosure is, however, not limited to the forms described above unless the following description particularly states that restrictions are imposed on the present disclosure.

1. First Embodiment

1a. Overview of System Using Time Display Apparatus

FIG. 1 shows an overview of the entirety of a system 100 using a time display apparatus 10 according to a first embodiment. In the system 100, the time display apparatus 10 is used in a moving object 40, which moves from a place of departure A to a destination B, as shown in FIG. 1 by way of example. The place of departure A and the destination B differ from each other in terms of time zone. Time Ta at the place of departure A and time Tb at the destination B differ from each other by a time difference. The term "time zone" used herein is a regional segment using standard time. The "standard time" is expressed by the time difference from UTC (coordinated universal time).

The time display apparatus 10 can display time Tc in the time zone based on information on the position of the current location obtained by performing positioning calculation using a satellite signal received from a positioning satellite 20. The time display apparatus 10 can further display the time Tb in the time zone based on information representing the time zone corresponding to the destination B and contained in a wireless signal received from a transmitter 30 provided in the moving object 40.

The time display apparatus 10, when it receives the wireless signal from the transmitter 30, displays the time Tb based on information representing the time zone corresponding to the destination B and contained in the wireless signal. The time display apparatus 10 then maintains the displayed time Tb for the period until the moving object 40 enters the time zone corresponding to the destination B.

The moving object 40 in the present embodiment is an airplane. The place of departure A and the destination B are therefore, for example, airports that belong to different time zones. The moving object 40 only needs to carry a user who wears or carries the time display apparatus 10 and is movable with the user. The moving object 40 is not limited to an airplane and may instead, for example, be an automobile, a ship, or a railroad.

1b. Time Display Apparatus

Figure 2:
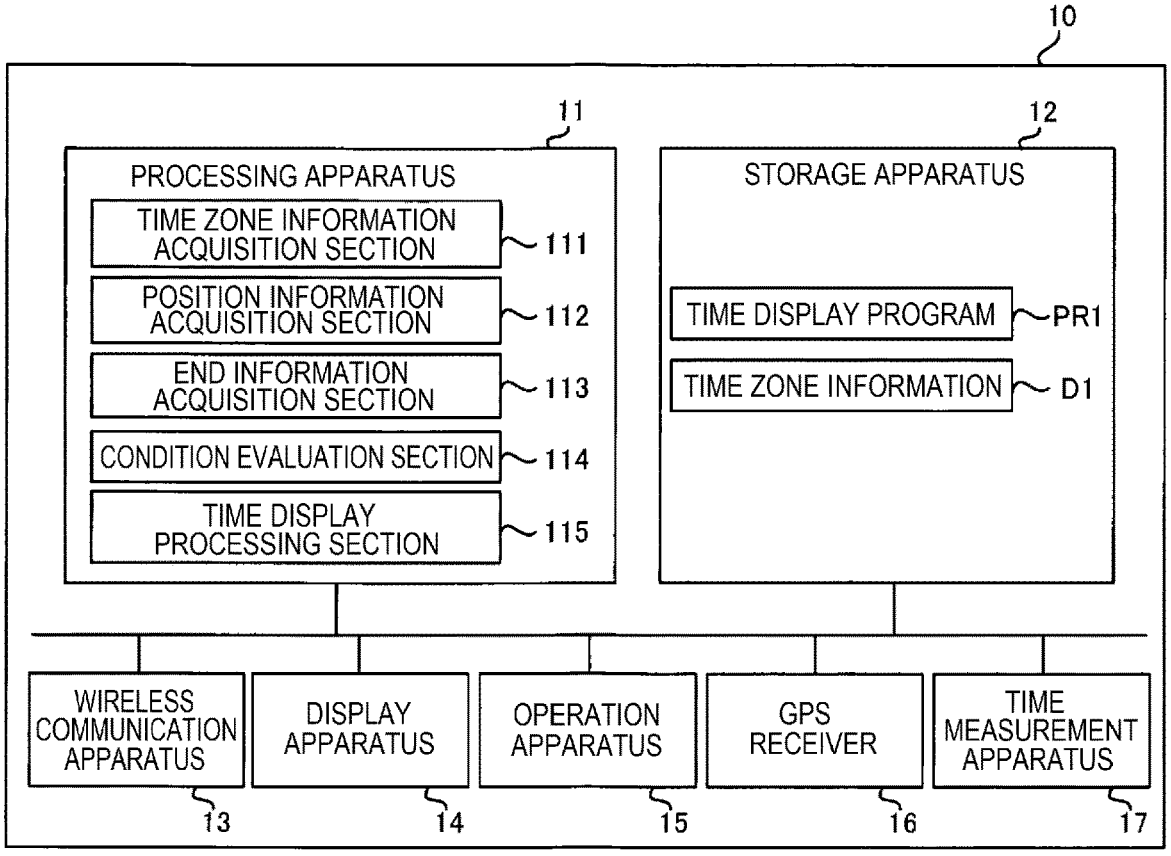
FIG. 2 shows the configuration of a time display apparatus according to the first embodiment.

FIG. 2 shows the configuration of the time display apparatus 10 according to the first embodiment. The time display apparatus 10 includes a processing apparatus 11, a storage apparatus 12, a wireless communication apparatus 13, a display apparatus 14, an operation apparatus 15, a GPS (global positioning system) receiver 16, and a time measurement apparatus 17. The elements of the time display apparatus 10 are connected to each other via one or more buses.

The processing apparatus 11 is a processor that controls the entire time display apparatus 10 and is formed, for example, of one or more chips. The processing apparatus 11 is, for example, formed of a CPU (central processing unit) including an interface to the peripheral apparatuses, a computation apparatus, a register, and other components. Part or entirety of the functions of the processing apparatus 11 may be achieved by hardware, such as a DSP (digital signal processor), ASIC (application specific integrated circuit), PLD (programmable logic device), and FPGA (field programmable gate array). The processing apparatus 11 concurrently or sequentially executes a variety of processes.

The storage apparatus 12 is a recording medium readable by the processing apparatus 11 and stores a plurality of programs including a time display program PR1 executed by the processing apparatus 11 and a variety of data including time zone information D1 used by the processing apparatus 11. The storage apparatus 12 is formed, for example, of one or more types of storage circuit, such as a ROM (read only memory), an EPROM (erasable programmable ROM), EEPROM (electrically erasable programmable ROM), and RAM (random access memory). The time zone information D1 is information on the time difference from UTC (coordinated universal time).

The wireless communication apparatus 13 is a "first reception section" or a "first receiver" that receives the wireless signal containing information on the time zone corresponding to the destination B. The wireless communication apparatus 13 is an apparatus that requests wireless connection with the transmitter 30 and receives the wireless signal. The wireless communication apparatus 13 only needs to be an apparatus that performs the communication using a wireless signal other than a satellite signal and may, for example, be an apparatus based on a wireless communication scheme, such as LPWA (low power wide area), a wireless LAN (local area network) including Wi-Fi, and Bluetooth. The wireless communication apparatus 13 may be capable of communicating with an apparatus other than the transmitter 30 via a network, such as a mobile communication network and the Internet. Wi-Fi and Bluetooth are each a registered trademark.

The display apparatus 14 displays a variety of images under the control of the processing apparatus 11. The display apparatus 14 is a display apparatus including, for example, any of a variety of display panels, such as a liquid crystal display panel, and an organic EL (electro-luminescence) display panel, or indicating hands. The display apparatus 14 functions as a "display section" that displays the time. For example, the display apparatus 14 displays an image showing the time, such as the time Ta, Tb, and Tc.

The operation apparatus 15 is an instrument for inputting information used by the time display apparatus 10 to the processing apparatus 11. The operation apparatus 15 accepts the user's operation. Specifically, the operation apparatus 15 accepts operation for inputting a code, such as a numeral and a letter, and operation for selecting an icon displayed on the display apparatus 14. For example, a touch panel that detects contact with the display surface of the display apparatus 14 is preferable as the operation apparatus 15.

The GPS receiver 16 is a "second reception section" or a "second receiver" that receives the satellite signal from the positioning satellite 20 to perform the positioning and calculates the information on the position of the current location. The information on the position of the current location may be expressed in any format that allows identification of a reception point where the satellite signal is received or a position based on the reception point. For example, the information on the position of the current location is information on the latitude and longitude representing a position on the earth. The positioning satellite 20 is a GPS satellite. The positioning satellite 20 is not limited to a GPS satellite and may instead, for example, be EU's Galileo, Russia's GLONASS, China's Hokuto, or any other global navigation satellite system (GNSS), a geostationary satellite, such as SBAS, or a quasi-zenith satellite. In this case, a receiver according to the type of positioning satellite 20 may be used as the second reception section in place of the GPS receiver 16.

The time measurement apparatus 17 produces internal time in the form of time/date information representing the current time and date. Specifically, the time measurement apparatus 17 generates the time-date information by counting a pulse signal produced by dividing a clock signal produced, for example, by a quartz oscillator.

In the thus configured time display apparatus 10, the processing apparatus 11 reads and executes the time display program PR1 from the storage apparatus 12 to function as a time zone information acquisition section 111, a position information acquisition section 112, an end information acquisition section 113, a condition determination section 114, and a time display processing section 115.

The time zone information acquisition section 111 acquires the information on the time zone corresponding to the destination B from the wireless signal received by the wireless communication apparatus 13. The position information acquisition section 112 acquires the information on the position of the current location from the GPS receiver 16. The end information acquisition section 113 acquires end information, which will be described later, from the wireless signal received by the wireless communication apparatus 13.

The condition determination section 114 determines whether or not the wireless communication apparatus 13 has received the wireless signal, and in the case where the wireless communication apparatus 13 has received the wireless signal, the condition determination section 114 determines whether or not a predetermined condition has been satisfied. The "predetermined condition" used herein is a condition that the position of the time display apparatus 10 falls within the time zone corresponding to the destination B.

In the present embodiment, when the time zone information acquisition section 111 has acquired the information on the time zone corresponding to the destination B, the condition determination section 114 determines that the wireless communication apparatus 13 has acquired the wireless signal. The condition determination section 114 in the present embodiment then determines whether or not the end information acquisition section 113 has acquired the end information, and in a case where the end information acquisition section 113 has acquired the end information, the condition determination section 114 determines that the predetermined condition has been satisfied. The determination of whether or not the wireless communication apparatus 13 has received the wireless signal made by the condition determination section 114 is not limited to the determination based on the acquisition state of the time zone information acquisition section 111. For example, the determination may be made based on information other than the time zone information contained in the wireless signal received by the wireless communication apparatus 13.

The time display processing section 115 calculates time information based on the internal time produced by the time measurement apparatus 17 and the time zone information D1 stored in the storage apparatus 12 and causes the display apparatus 14 to display the time based on the time information. The time display processing section 115 rewrites the time zone information D1 based on the information acquired by the time zone information acquisition section 111 and the position information acquisition section 112 and determination result by the condition determination section 114 to change the time displayed by the display apparatus 14.

More specifically, in a case where the time zone information acquisition section 11 has acquired the information on the time zone corresponding to the destination B and the time zone information differs from the time zone information D1, the time display processing section 115 causes the storage apparatus 12 to store the time zone information acquired by the time zone information acquisition section 111 as the time zone information D1. In this case, the time display processing section 115 executes a first process of setting the time to be displayed on the display apparatus 14 based on the information on the time zone corresponding to the destination B.

In a case where the time zone information acquisition section 111 has never acquired the information on the time zone corresponding to the destination B, or in a case where not only does the condition determination section 114 determine that the predetermined condition has been satisfied, but the position information acquisition section 112 has acquired the information on the position of the current location, and time zone information based on the position differs from the time zone information D1, the time display processing section 115 causes the storage apparatus 12 to store the time zone information based on the position information as the time zone information D1. In this case, the time display processing section 115 executes a second process of setting the time to be displayed on the display apparatus 14 based on the information on the position of the current location.

Therefore, in the case where the time zone information acquisition section 111 has acquired the information on the time zone corresponding to the destination B, the time display processing section 115 does not execute the second process but preferentially executes the first process for the period until the condition determination section 114 determines that the predetermined condition has been satisfied. In the following description, the period from the time at which the time zone information acquisition section 111 acquires the information on the time zone corresponding to the destination B to the time at which the condition determination section 114 determines that the predetermined condition has been satisfied is also called a "second process prohibition period."

In the present embodiment, the time display processing section 115 prohibits the second process from being executed by causing the GPS receiver 16 to stop its reception action for the second process prohibition period. It is, however, noted that the GPS receiver 16 may perform its reception action in the second process prohibition period. In this case, for example, the position information acquisition section 112 only needs to be allowed to acquire no position information.

As described above, the processing apparatus 11 is a "processing section" or a processor that can selectively execute the first and second processes.

1c. Transmitter

Figures 3, 4:
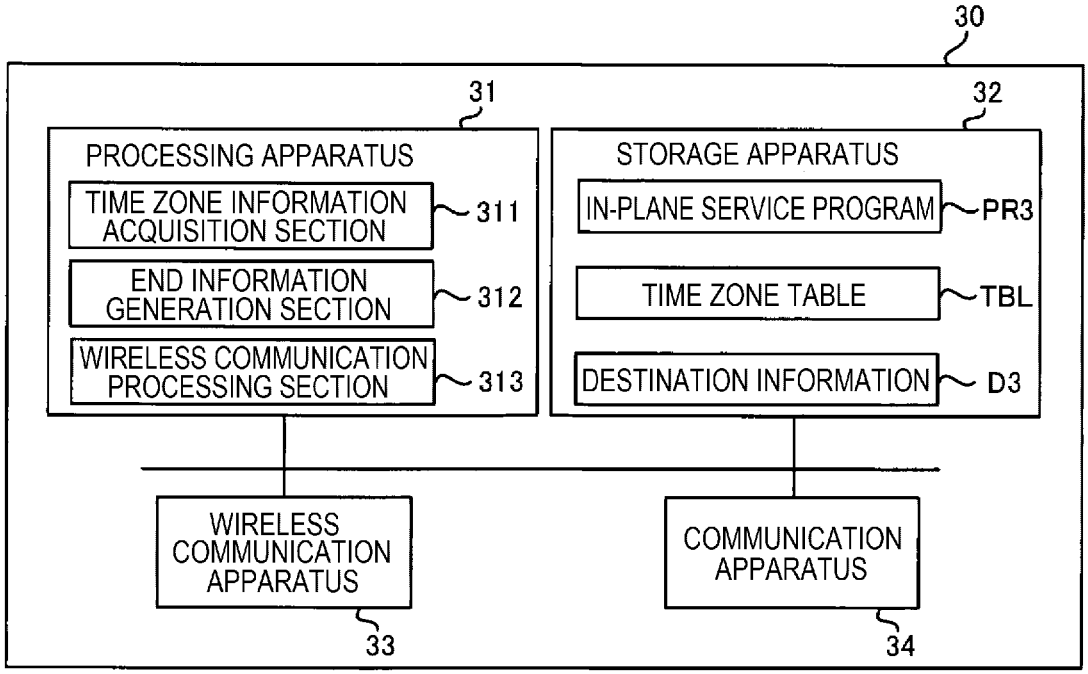
FIG. 3 shows the configuration of a transmitter according to the first embodiment.
FIG. 4 shows an example of a time zone table.

FIG. 3 shows the configuration of the transmitter 30 according to the first embodiment. The transmitter 30 includes a processing apparatus 31, a storage apparatus 32, a wireless communication apparatus 33, and a communication apparatus 34. The elements of the transmitter 30 are connected to each other via one or more buses.

The processing apparatus 31, the storage apparatus 32, and the wireless communication apparatus 33 have the same configurations as those of the processing apparatus 11, the storage apparatus 12, and the wireless communication apparatus 13, respectively. The storage apparatus 32, however, differs from the storage apparatus 12 in that the storage apparatus 32 stores an in-plane service program PR3, a time zone table TBL, and destination information D3. The destination information D3 is information on the destination B of the moving object 40. The destination information D3 may be expressed in any format that allows identification of the position of the destination B. For example, the destination information D3 is information on an airport code. The destination information D3 is not limited to the information on an airport code and may, for example, be information on the latitude and longitude representing the position of the destination B on the earth.

The communication apparatus 34 is an instrument that communicates with another apparatus via a network, such as a mobile communication network and the Internet. For example, the communication apparatus 34 communicates with the other apparatus, such as a server, to receive information, such as the destination information D3, which is the information on the destination B of the moving object 40. The received information is stored in the storage apparatus 32. The communication apparatus 34 may receive information, for example, on the route of the moving object 40 and the arrival time at which the moving object 40 arrives at the destination in addition to the destination information D3.

In the thus configured transmitter 30, the processing apparatus 31 reads and executes the in-plane service program PR3 from the storage apparatus 32 to function as a time zone information generation section 311, an end information generation section 312, and a wireless communication processing section 313.

The time zone information generation section 311 generates the information on the time zone corresponding to the destination B based on the time zone table TBL and the destination information D3. The information on the time zone corresponding to the destination B is information on the time difference from UTC (coordinated universal time) at the destination B.

FIG. 4 shows an example of the time zone table TBL. In the case where the moving object 40 is an airplane, as in the present embodiment, the time zone table TBL relates, for example, the information on the destination B to the information on the time zone, as shown in FIG. 4. In the example shown in FIG. 4, the information on the destination B is information representing the airport code at the destination B, and the information on the time zone is information representing the time difference from UTC at the destination B.

Referring back to FIG. 3, before the wireless communication section 33 stops transmitting a wireless signal produced by the in-place service, the end information generation section 312 generates the end information, which is information on an advance notice of the end of the transmission. The end information may be expressed in any format identifiable by the end information acquisition section 113 of the time display apparatus 10 described above.

In the present embodiment, the end information generation section 312 determines whether or not the moving object 40 is ready for landing, and in a case where the moving object 40 is ready for landing, the end information generation section 312 generates the end information. The end information generation section 312 can acquire information representing that the moving object 40 is ready for landing from the communication apparatus 34 and determines whether or not the moving object 40 is ready for landing based on whether or not the information has been acquired. The information is, for example, information on an input from a switch operated, for example, by a cabin attendant of the moving object 40, a signal from an inertia sensor provided in the moving object 40, and a signal that turns on the seat belt sign in the moving object 40.

The wireless communication processing section 313 executes the process of transmitting a wireless signal to the wireless communication apparatus 33. More specifically, the wireless communication processing section 313 executes the process of causing the wireless communication apparatus 33 to transmit the wireless signal containing the information on the time zone corresponding to the destination B generated by the time zone information generation section 311 in a timely manner, for example, whenever a fixed period elapses, within the period during which the in-plane service is performed. In the case where the end information generation section 312 has generated the end information, the wireless communication processing section 313 executes the process of causing the wireless communication apparatus 33 to transmit a wireless signal containing the end information.

In the present embodiment, the wireless communication processing section 313 determines whether or not the moving object 40 is flying in the form of level flight, and in a case where the moving object 40 is flying in the form of level flight, the wireless communication processing section 313 causes the wireless communication apparatus 33 to transmit the information on the time zone corresponding to the destination B. The wireless communication processing section 313 can acquire information representing that the moving object 40 is flying in the form of level flight from the communication apparatus 34 and determines whether or not the moving object 40 is flying in the form of level flight based on whether or not the information has been acquired. The information is, for example, information on an input from a switch operated, for example, by a cabin attendant of the moving object 40, a signal from an inertia sensor provided in the moving object 40, a signal that turns off the seat belt sign in the moving object 40. The transmission start timing of the information on the time zone corresponding to the destination B is not limited to any of the timings described above and may be arbitrarily set.

1d. Action of Time Display Apparatus 10

Figure 5:
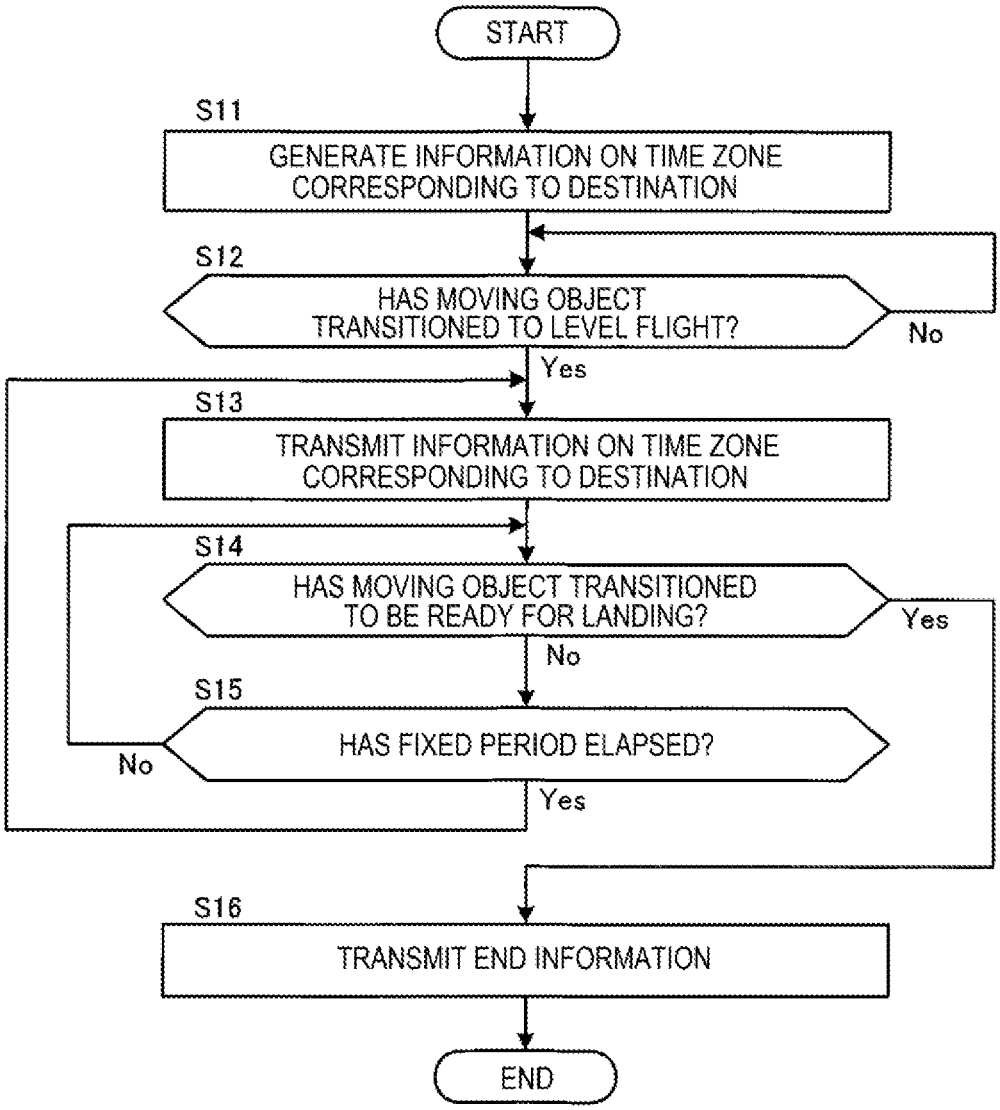
FIG. 5 is a flowchart showing the action of the transmitter according to the first embodiment.

FIG. 5 is a flowchart showing the action of the transmitter 30 according to the first embodiment. After the moving object 40 takes off from the place of departure A, the time zone information generation section 311 first generates the information on the time zone corresponding to the destination B in step S11.

Thereafter, in step S12, the wireless communication processing section 313 determines whether or not the moving object 40 has transitioned to level flight after the takeoff. Step S12 is repeated until the moving object 40 transitions to level flight.

When the moving object 40 has transitioned to level flight, the wireless communication processing section 313 causes the wireless communication apparatus 33 to transmit the wireless signal containing the information on the time zone corresponding to the destination B in step S13.

Thereafter, in step S14, the end information generation section 312 determines whether or not the moving object 40 has transitioned to be ready for landing. In a case where the moving object 40 has not transitioned to be ready for landing, the wireless communication processing section 313 determines in step S15 whether or not a fixed period has elapsed. In a case where the fixed period has not elapsed, the processing apparatus 21 transitions to step S14 described above, whereas in a case where the fixed period has elapsed, the processing apparatus 21 transitions to step S13 described above.

On the other hand, in a case where the moving object 40 has transitioned to be ready for landing, the end information generation section 312 generates the end information, and the wireless communication processing section 313 causes the wireless communication apparatus 33 to transmit the wireless signal containing the end information in step S16. The in-plane service is then terminated.

Figure 6:
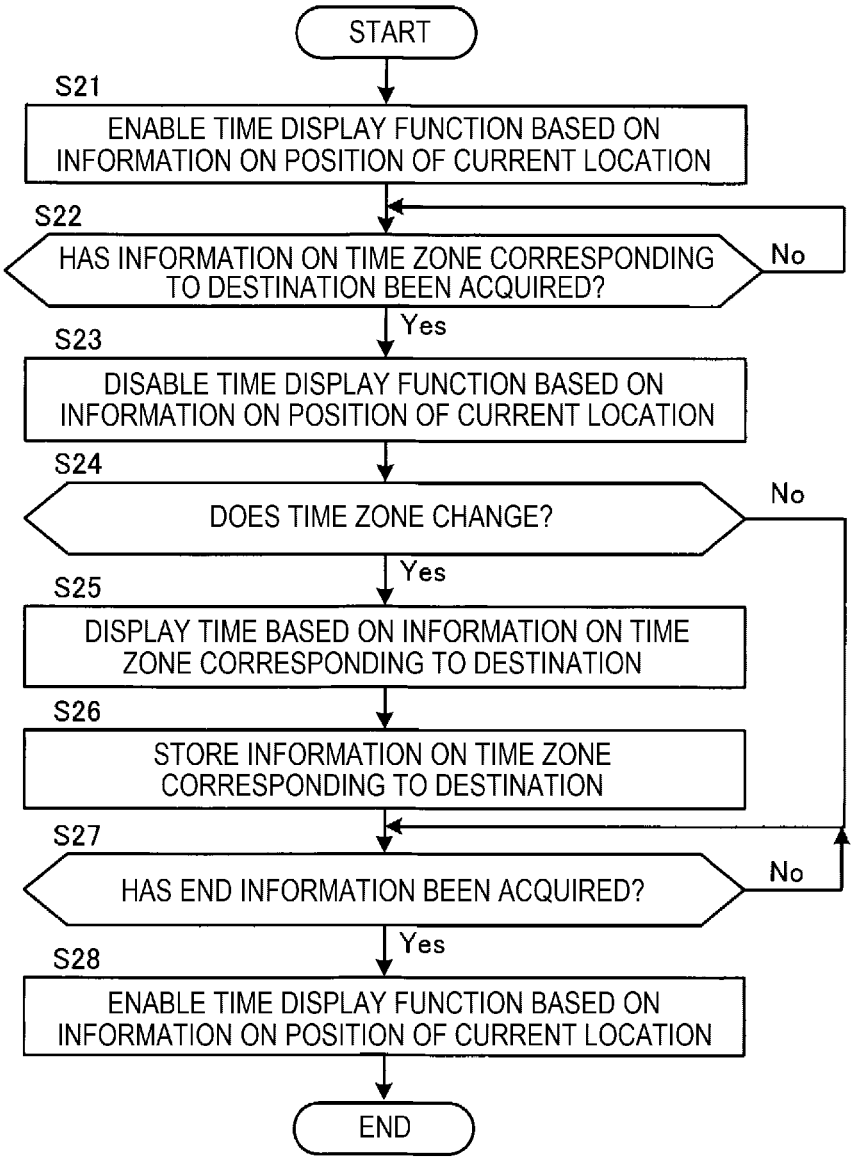
FIG. 6 is a flowchart showing the action of the time display apparatus according to the first embodiment.

FIG. 6 is a flowchart showing the action of the time display apparatus 10 according to the first embodiment. First, in step S21, the time display processing section 115 enables the function of displaying the time based on the information on the position of the current location. That is, the processing apparatus 11 causes the second process to be executable.

Thereafter, in step S22, the condition determination section 114 determines whether or not the time zone information acquisition section 111 has received the information on the time zone corresponding to the destination B. Step S22 is repeated until the time zone information acquisition section 111 receives the information on the time zone corresponding to the destination B.

In the case where the time zone information acquisition section 111 receives the information on the time zone corresponding to the destination B, the time display processing section 115 disables in step S23 the function of displaying the time based on the information on the position of the current location. That is, the processing apparatus 11 prohibits the second process from being executed.

Thereafter, in step 324, the time display processing section 115 compares the information on the time zone corresponding to the destination B acquired by the time zone information acquisition section 111 with the time zone information D1 stored in the storage apparatus 12 and determines whether or not the time zone information changes.

In a case where the time zone information changes, the time display processing section 115 causes in step S25 the display apparatus 14 to display the time based on the information on the time zone corresponding to the destination B acquired by the time zone information acquisition section 111. That is, in this case, the processing apparatus 11 executes the first process.

In step S26, the time display processing section 115 replaces the time zone information D1 stored in the storage apparatus 12 with the information on the time zone corresponding to the destination B and stores the information on the time zone corresponding to the destination B as new time zone information D1 in the storage apparatus 12. Thereafter, in step S27, the condition determination section 114 determines whether or not the end information acquisition section 113 has acquired the end information. Step S27 is repeated until the end information is acquired. Step 27 is executed also in a case where the time zone information does not change in step S24 described above.

In the case where the end information acquisition section 113 has acquired the end information, the time display processing section 115 enables in step S28 the function of displaying the time based on the information on the position of the current location again. The prohibition of the second process is thus released.

Figure 7:
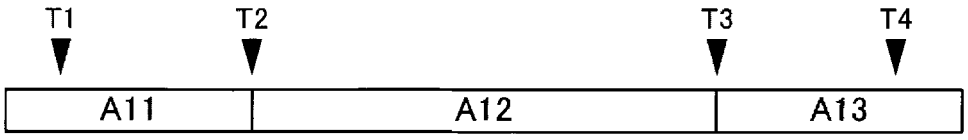
FIG. 7 describes the transition of the action of the time display apparatus according to the first embodiment.

FIG. 7 describes the transition of the action of the time display apparatus 10 according to the first embodiment. FIG. 7 shows a timing T1, at which the moving object 40 departs from the place of departure A, a timing T2, at which the wireless communication apparatus 13 receives the wireless signal, a timing T3, at which the end information acquisition section 113 acquires the end information, and a timing T4, at which the moving object 40 arrives at the destination B.

In a period A11 containing the timing T1 before the timing T2, in the case where the GPS receiver 16 receives the satellite signal from the positioning satellite 20, the second process is executed, and the display apparatus 14 displays the time based on the position information according to the result of the positioning performed by the GPS receiver 16.

In a period A12 from the timing T2 to the timing T3, the first process is executed, and the display apparatus 14 displays the time based on the time zone information from the transmitter 30. In the period A12, the second process is prohibited from being executed. To this end, causing the GPS receiver 16 to stop its reception action prohibits the second process from being executed. The electric power consumed by the time display apparatus 10 can thus be lowered.

In a period A13 containing the timing T4 after the timing T3, the prohibition of the execution of the second process is released. Therefore, when the GPS receiver 16 receives the satellite signal from the positioning satellite 20, the second process is executed, the display apparatus 14 displays the time based on the position information according to the result of the positioning performed by the GPS receiver 16. The position information coincides with the information on the time zone corresponding to the destination B. Therefore, even when the second process is executed in the period A13, the time displayed on the display apparatus 14 does not change.

According to the time display apparatus 10 described above, in the case where the wireless communication apparatus 13 receives the wireless signal, the processing apparatus 11 does not execute the second process for the second process prohibition period or until the processing apparatus 11 determines that the predetermined condition has been satisfied. Therefore, even when the GPS receiver 16 receives the satellite signal from the positioning satellite 20, the display apparatus 14 can display for the second process prohibition period the time based on the information on the time zone corresponding to the destination B received from the wireless communication apparatus 13. Further, after the position based on the position information from the GPS receiver 16 falls within the positional range based on the information on the time zone corresponding to the destination B, the second process can be executed. Therefore, when the second process is executed after the second process prohibition period, the time displayed on the display apparatus 14 does not change but the display apparatus 14 keeps displaying the time at the destination B, or the display apparatus 14 can properly display the time in a time zone corresponding to a position to which the moving object 40 moves from the destination B afterward. Unintended time display can thus be avoided.

The processing apparatus 11 causes the display apparatus 14 to display the time based on the information on the time zone corresponding to the destination B for the second process prohibition period. The display described above can increase the user's convenience.

In the present embodiment, the transmitter 30, when it stops transmitting the wireless signal, transmits the end information, which is the information on an advance notice of the end of the transmission, as part of the wireless signal. When the wireless communication apparatus 13 receives the end information, the processing apparatus 11 determines that the predetermined condition has been satisfied. The determination described above allows, without use of the position information from the GPS receiver 16, determination that the position of the time display apparatus 10 falls within the positional range based on the information on the time zone corresponding to the destination B.

Further, the processing apparatus 11 causes the GPS receiver 16 to stop its reception action for the second process prohibition period. Causing the GPS receiver 16 to stop its reception action as described above allows reduction in the power consumption in the second process prohibition period.

Second Embodiment

A second embodiment will next be described. The present embodiment is the same as the first embodiment described above except that the method for determining the timings at which the execution of the second process is prohibited and the prohibition is released. The following description of the second embodiment will be made primarily on the differences from the first embodiment described above, and no description of the same items will be made. Further, in the figures used to describe the second embodiment, the same configurations as those in the first embodiment described above have the same reference characters.

Figure 8:
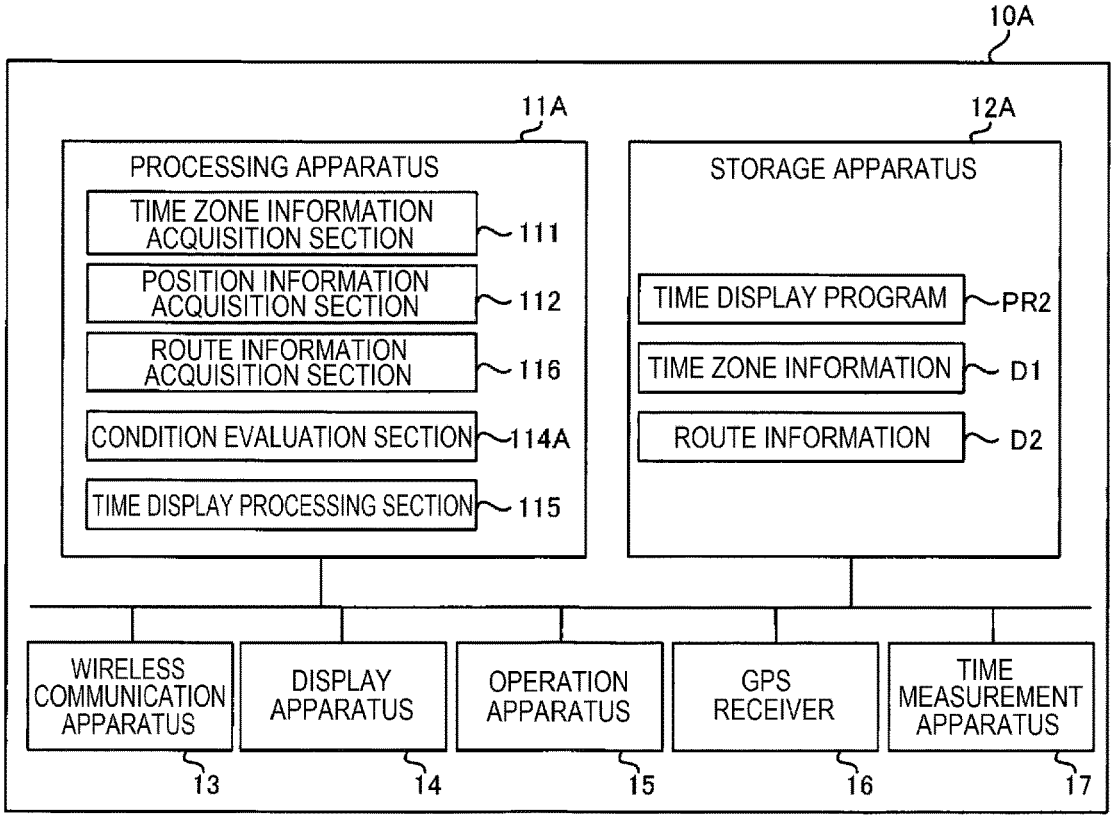
FIG. 8 shows the configuration of a time display apparatus according to a second embodiment.

FIG. 8 shows the configuration of a time display apparatus 10A according to the second embodiment. The time display apparatus 10A is the same as the time display apparatus 10 according to the first embodiment except that the processing apparatus 11 and the storage apparatus 12 in the first embodiment are replaced with a processing apparatus 11A and a storage apparatus 12A.

The storage apparatus 12A stores a time display program PR2 executed by the processing apparatus 11A, which is the "processing section" The processing apparatus 11A executes the time display program PR2 to function as the time zone information acquisition section 111, the position information acquisition section 112, a condition determination section 114A, the time display processing section 115, and a route information acquisition section 116.

The route information acquisition section 116 acquires route information D2 from the wireless signal received by the wireless communication apparatus 13.

The condition determination section 114A operates in the same manner as does the condition determination section 114 in the first embodiment described above, that is, in the case where the time zone information acquisition section 111 acquires the information on the time zone corresponding to the destination B, the condition determination section 114A determines that the wireless communication apparatus 13 has received the wireless signal. Based on the information on the time zone corresponding to the destination B acquired by the time zone information acquisition section 111 and the information on the position of the current location acquired by the position information acquisition section 112, the condition determination section 114A in the present embodiment determines that the predetermined condition has been satisfied in a case where the position based on the position information falls within the positional range based on the time zone information.

Further, when the route information acquisition section 116 acquires the route information, the condition determination section 114A determines that the predetermined condition has been satisfied.

Moreover, based on the information on the position of the current location acquired by the position information acquisition section 112 and the route information acquired by the route information acquisition section 116, the condition determination section 114A determines that the predetermined condition has been satisfied in a case where the position based on the position information is not located on a route based on the route information.

The time display processing section. 115 then executes the process of causing the display apparatus 14 to display the time based on the acquisition states of the time zone information acquisition section 111 and the position information acquisition section 112 and the result of the determination performed by the condition determination section 114A. In the first embodiment described above, causing the GPS receiver 16 to stop its reception action prohibits the second process from being executed in the second process prohibition period, whereas in the present embodiment, the GPS receiver 16 is allowed to perform its reception action in the second process prohibition period.

Figure 9:
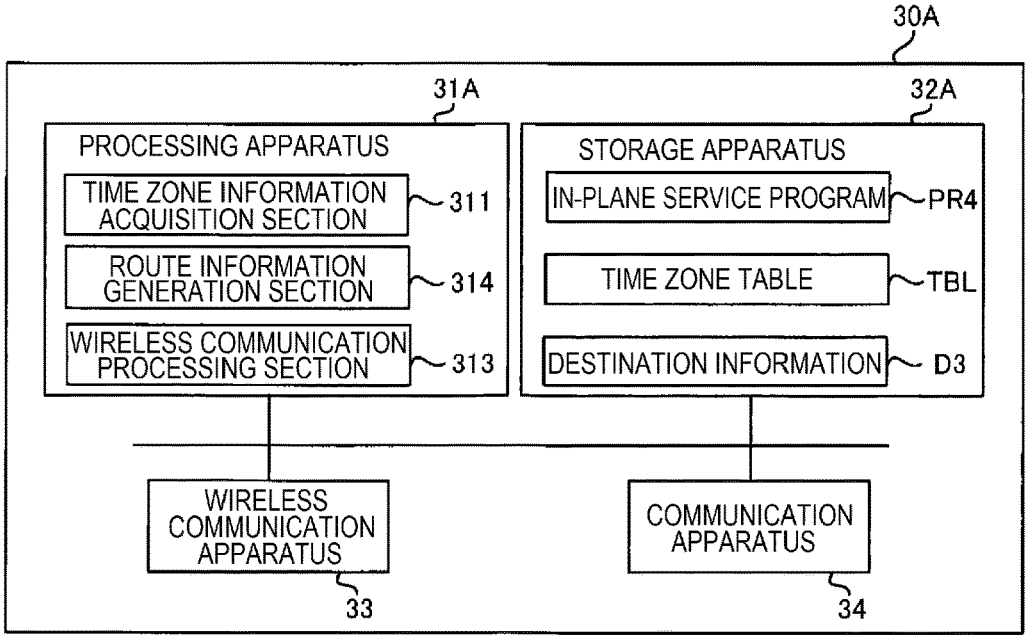
FIG. 9 shows the configuration of a transmitter according to the second embodiment.

FIG. 9 shows the configuration of a transmitter 30A according to the second embodiment. The transmitter 30A is the same as the transmitter 30 in the first embodiment except that the processing apparatus 31 and the storage apparatus 32 in the first embodiment are replaced with a processing apparatus 31A and a storage apparatus 32A.

The storage apparatus 32A stores an in-plane service program PR4 executed by the processing apparatus 31A. The processing apparatus 31A reads and executes the in-plane service program PR4 from the storage apparatus 32A to function as the time zone information generation section 311, the wireless communication processing section 313, and a route information generation section 314.

The route information generation section 314 generates the route information, which is information on the route along which the moving object 40 moves from the place of departure A to the destination B, based on the destination information D3. The route information may be expressed in any format but contains information on the latitude and longitude representing a position on the earth. Further, from the viewpoint of an increase in the accuracy of the determination, performed by the condition determination section 114A described above, of whether or not the position based on the information on the position of the current location is located on the route based on the route information, the route information preferably contains information on the altitude.

The wireless communication processing section 313 then executes the process of causing the wireless communication apparatus 33 to transmit a wireless signal containing the information on the time zone corresponding to the destination B and the route information.

Figure 10:
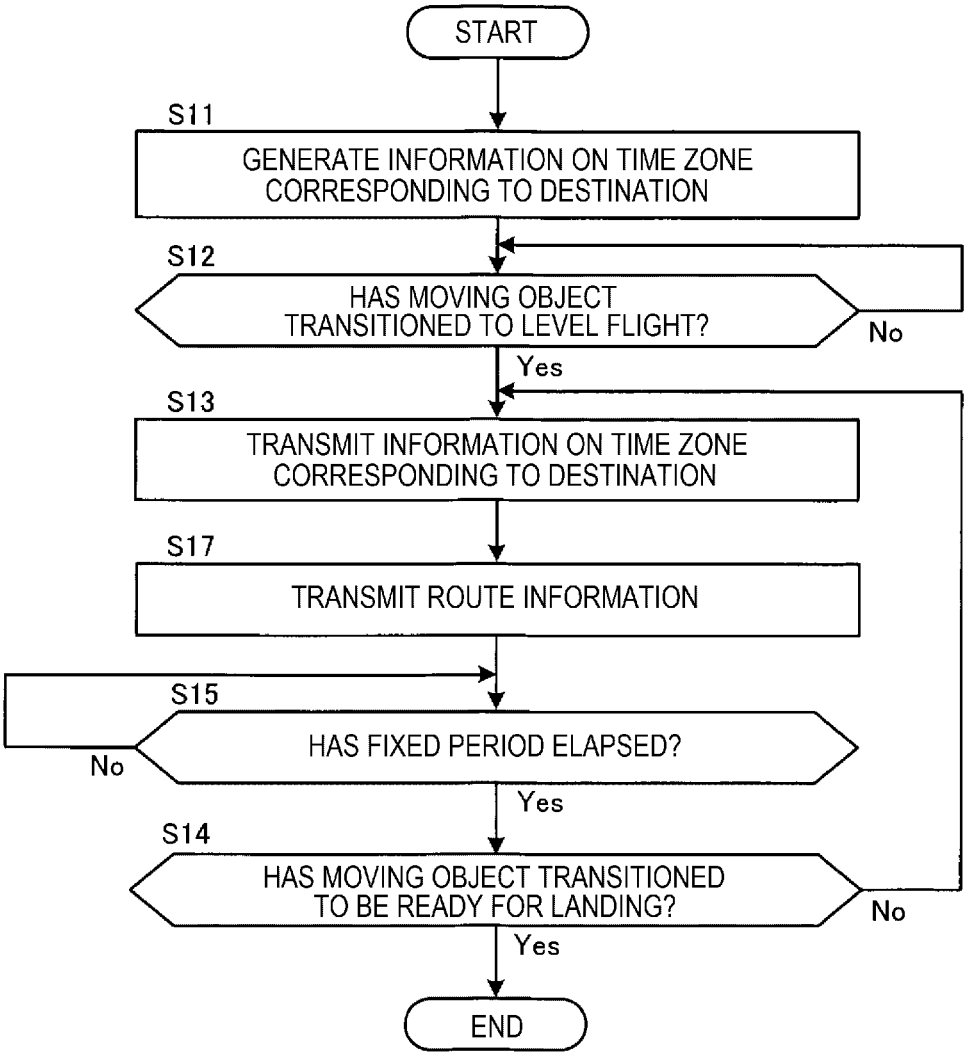
FIG. 10 is a flowchart showing the action of the transmitter according to the second embodiment.

FIG. 10 is a flowchart showing the action of the transmitter 30A according to the second embodiment. After the moving object 40 takes off the place of departure A, the processing apparatus 31A first sequentially executes steps S11, S12, and S13, as in the first embodiment described above.

Thereafter, in step S17, the wireless communication processing section 313 causes the wireless communication apparatus 33 to issue the wireless signal containing the route information. Thereafter, in step S15, the wireless communication processing section 313 determines whether or not a fixed period has elapsed and repeats step S15 until the fixed period elapses.

In a case where the fixed period has elapsed, the processing apparatus 31A determines in step S14 whether or not the moving object 40 has transitioned to be ready for landing. In a case where the moving object 40 has not transitioned to be ready for landing, the processing apparatus 31A transitions to step S13, whereas in a case where the moving object 40 has transitioned to be ready for landing, the processing apparatus 31A terminates the in-plane service.

Figure 11:
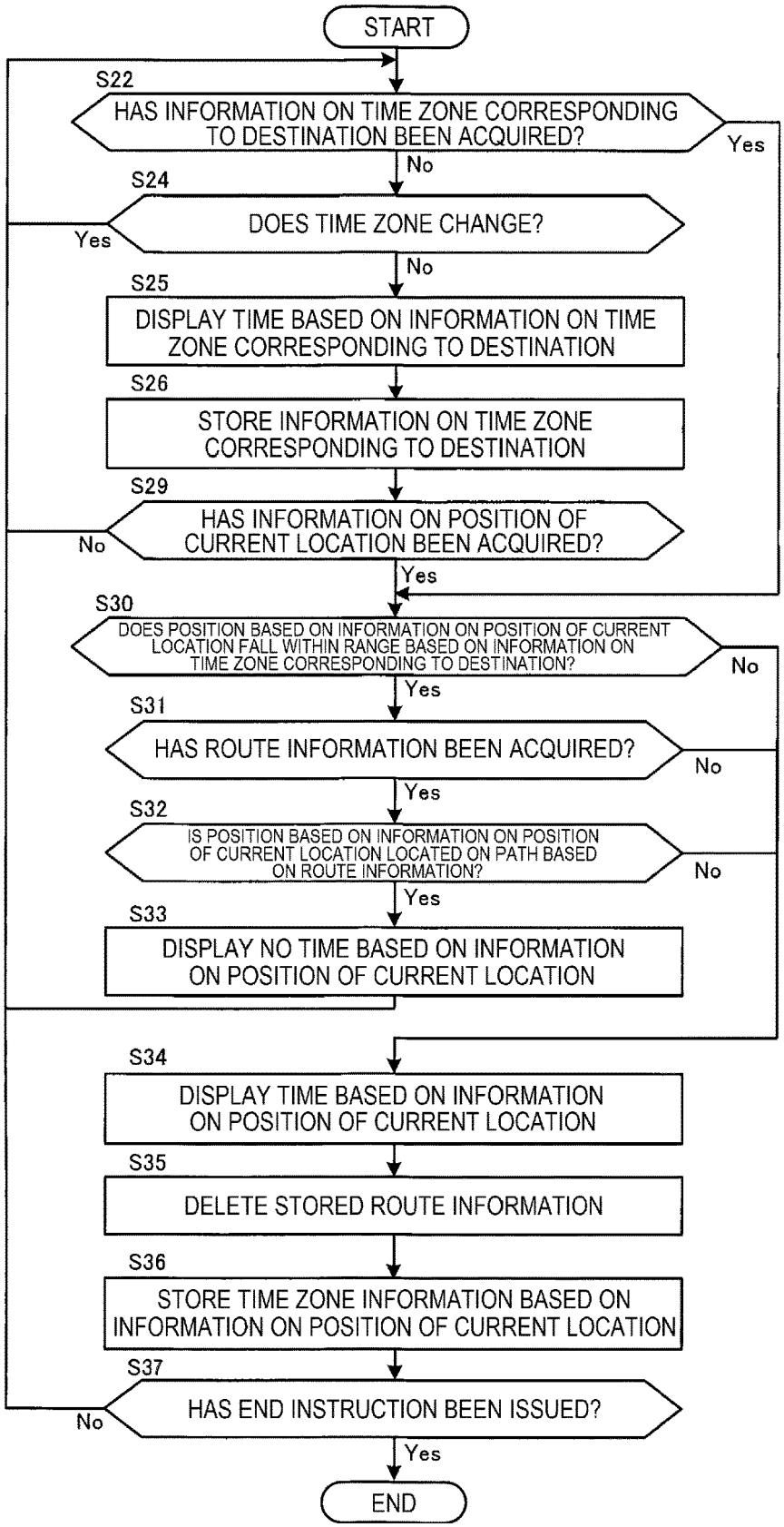
FIG. 11 is a flowchart showing the action of the time display apparatus according to the second embodiment.

FIG. 11 is a flowchart showing the action of the time display apparatus 10A according to the second embodiment. First, in step S22, the condition determination section 114A determines whether or not the time zone information acquisition section 111 has received the information on the time zone corresponding to the destination B. In the case where the time zone information acquisition section 111 has received the information on the time zone corresponding to the destination B, the processing apparatus 31A transitions to step 330, which will be described later. On the other hand, in the case where the time zone information acquisition section 111 has not received the information on the time zone corresponding to the destination B, the time display processing section 115 sequentially executes steps S24, S25, and S26, as in the first embodiment described above. In the case where the time zone changes in step S24, the processing apparatus 31A transitions to step S22.

After step S25, in step S29, the time display processing section 115 determines whether or not the position information acquisition section 112 has acquired the position information. In the case where the position information acquisition section 112 has not acquired the position information, the processing apparatus 31A transitions to step S22.

In the case where the position information acquisition section 112 has acquired the position information, in step S30, the time display processing section 115 determines whether or not the position based on the information on the position of the current location falls within the range based on the information on the time zone corresponding to the destination B. In the case where the position based on the information on the position of the current location falls within the range based on the information on the time zone corresponding to the destination B, the time display processing section 115 determines in step S31 whether or not the route information acquisition section 116 has acquired the route information.

In a case where the route information acquisition section 116 has acquired the route information, the time display processing section 115 determines in step S32 whether or not the position based on the information on the position of the current location is located on the path based on the route information. In the case where the position based on the information on the position of the current location is located on the path based on the route information, the display apparatus 14 is not caused to display the time based on the information on the position of the current location in step S33, but the processing apparatus 31A transitions to step S22.

In steps S30, S31, and S32 described above, in any of the case where the position based on the information on the position of the current location does not fall within the range based on the information on the time zone corresponding to the destination B, the case where the route information acquisition section 116 has acquired no route information, and the case where the position based on the information on the position of the current location is not located on the path based on the route information, the time display processing section 115 causes the display apparatus 14 to display the time based on the information on the position of the current location in step S34.

Thereafter, in step S35, the time display processing section 115 deletes the route information D2 stored in the storage apparatus 12. Thereafter, in step S36, the time display processing section 115 stores the time zone information based on the information on the information on the position of the current location in the storage apparatus 12, and in step S37, the processing apparatus 31A transitions to step S22 in the case where no end instruction has been issued, whereas the processing apparatus 31A terminates the entire processes in the case where the end instruction has been issued.

Figure 12:
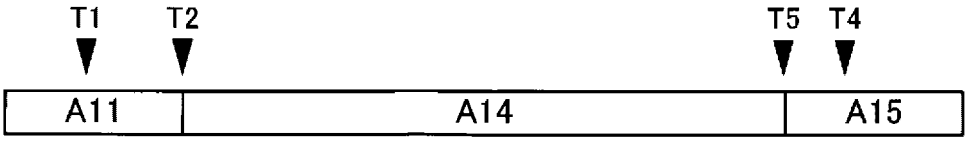
FIG. 12 describes the transition of the action of the time display apparatus according to the second embodiment.

FIG. 12 describes the transition of the action of the time display apparatus 10A according to the second embodiment. FIG. 12 shows the timing T1, at which the moving object 40 departs from the place of departure A, the timing T2, at which the wireless communication apparatus 13 receives the wireless signal, the timing T4, at which the moving object 40 arrives at the destination B, and a timing T5, at which the moving object 40 enters the time zone corresponding to the destination B.

In the present embodiment, in a period A14 from the timing T2 to the timing T5, the first process is executed, and the display apparatus 14 displays the time based on the information representing the time zone corresponding to the destination B and transmitted from the transmitter 30. In the period A14, the execution of the second process is prohibited. In the present embodiment, the GPS receiver 16 itself operates and performs the satellite-signal-based positioning to generate the position information. However, the generated position information is not used to correct the displayed time but is used in the determination performed by the condition determination section 114A described above.

In a period A15 containing the timing T4 after the timing T5, the prohibition of the execution of the second process is released. Therefore, when the GPS receiver 16 receives the satellite signal from the positioning satellite 20, the second process is executed, the display apparatus 14 displays the time based on the position information according to the result of the positioning performed by the GPS receiver 16. The position information coincides with the information on the time zone corresponding to the destination B. Therefore, even when the second process is executed in the period A15, the time displayed on the display apparatus 14 does not change.

According to the time display apparatus 10A described above, in the case where the wireless communication apparatus 13 receives the wireless signal, the processing apparatus 11A does not execute the second process for the second process prohibition period or until the processing apparatus 11A determines that the predetermined condition has been satisfied. The thus configured time display apparatus 10A can therefore provide the same effects as those provided in the first embodiment described above.

Further, in the present embodiment, the processing apparatus 11A determines that the predetermined condition has been satisfied in the case where the position based on the information on the position of the current location falls within the positional range corresponding to the information on the time zone corresponding to the destination B. Therefore, when the second process is executed after the second process prohibition period, the time displayed on the display apparatus 14 does not change but the display apparatus 14 keeps displaying the time Tb at the destination B, or the display apparatus 14 can properly display the time in a time zone corresponding to a position to which the moving object 40 moves from the destination B afterward.

The time display apparatus and the time correction method according to the present disclosure have been described above based on the embodiments shown in the drawings, but the present disclosure is not limited thereto. The configuration of each portion of the present disclosure can be replaced with an arbitrary configuration having the same function as that in the embodiments described above. Further, an arbitrary configuration can be added to the configurations in the embodiments described above. Moreover, in the present disclosure, arbitrary configurations in the embodiments described above may be combined with each other.

The embodiments described above have been described with reference to the case where the wireless signal from the transmitter allows the time display apparatus to perform service of displaying the time at a destination. The wireless signal from the transmitter may contain information on service other than the time displaying service. In this case, a variety of other types of service can be performed on a passenger on the moving object.

What is claimed is:

1. A time display apparatus comprising:

a display that displays time;

a first receiver that receives a wireless signal containing information on a first time zone corresponding to a destination from a transmitter provided in a moving object;

a second receiver that receives a satellite signal from a positioning satellite to perform positioning and calculates position information; and a processor that selectively executes a first process of setting time to be displayed on the display section based on the first time zone information and a second process of setting the time to be displayed on the display section based on the position information, wherein, the processor does not execute the second process for a period until the processor determines that a predetermined condition is satisfied when the moving object moves from a place in a second time zone different from the first time zone to the destination and the first reception section has received the wireless signal.

2. The time display apparatus according to claim 1, wherein the transmitter, when stopping transmitting the wireless signal, transmits end information, which is information on an advance notice of the end of the transmission, as part of the wireless signal, and the processor determines that the predetermined condition has been satisfied in a case where the first reception section has acquired the end information.

3. The time display apparatus according to claim 2, wherein the processor causes the second reception section to stop performing reception for the period.

4. The time display apparatus according to claim 1, wherein the processor determines that the predetermined condition has been satisfied in a case where a position based on the position information falls within a positional range corresponding to the time zone information.

5. The time display apparatus according to claim 2, wherein the processor determines that the predetermined condition has been satisfied in a case where a position based on the position information falls within a positional range corresponding to the time zone information.

6. The time display apparatus according to claim 1, wherein the processor causes the display to display time based on the time zone information for the period.

7. The time display apparatus according to claim 2, wherein the processor causes the display to display time based on the time zone information for the period.

8. The time display apparatus according to claim 3, wherein the processor causes the display to display time based on the time zone information for the period.

9. The time display apparatus according to claim 4, wherein the processor causes the display to display time based on the time zone information for the period.

10. A time correction method comprising:

executing, in a case where a first receiver receives a wireless signal containing information on a first time zone corresponding to a destination from a transmitter provided in a moving object, a first process of setting time to be displayed on a display section based on the first time zone information;

determining whether or not a predetermined condition is satisfied; and not executing, even when a second receiver receives a satellite signal from a positioning satellite, a second process of setting the time to be displayed on the display section based on position information calculated based on positioning using the satellite signal for a period until the predetermined condition is determined to have been satisfied when the moving object moves from a place in a second time zone different from the first time zone to the destination and the first receiver has received the wireless signal.

11. A time display apparatus comprising:

a display that displays time;

a first receiver that receives a wireless signal containing information on a first time zone corresponding to a destination from a transmitter provided in a moving object;

a second receiver that receives a satellite signal from a positioning satellite to perform positioning and calculates position information; and a processor that selectively executes a first process of setting time to be displayed on the display section based on the time zone information and a second process of setting the time to be displayed on the display section based on the position information, wherein, when the moving object moves from a place in a second time zone different from the first time zone to the destination, the processor:

executes the second process before the first reception section has received the wireless signal, executes the first process after the first reception section has received the wireless signal, for a period until the processor determines that a predetermined condition is satisfied, and executes the second process again only after the processor determines that the predetermined condition is satisfied.

* * * * *